US007351156B1

(12) United States Patent
Panneri et al.

(10) Patent No.: US 7,351,156 B1
(45) Date of Patent: Apr. 1, 2008

(54) GOLF BALL TEEING DEVICE

(75) Inventors: Alfred J. Panneri, Cheektowaga, NY (US); Ralph G. Stuart, Hamburg, NY (US)

(73) Assignee: Panneri Machining, Inc., Cheektowaga, NY (US)

( * ) Notice: Subject to any disclaimer, the term of this patent is extended or adjusted under 35 U.S.C. 154(b) by 0 days.

(21) Appl. No.: 11/531,378

(22) Filed: Sep. 13, 2006

(51) Int. Cl.
*A63B 47/00* (2006.01)
*A63B 53/00* (2006.01)

(52) U.S. Cl. ..... 473/132; 473/286

(58) Field of Classification Search ..... 473/282, 473/286, 131–137, 284; 294/19.2
See application file for complete search history.

(56) References Cited

U.S. PATENT DOCUMENTS

| | | | | |
|---|---|---|---|---|
| 3,239,264 | A | 3/1966 | Dupont | |
| 3,318,628 | A * | 5/1967 | White | 294/19.2 |
| 4,313,604 | A | 2/1982 | Baxter | |
| 5,460,366 | A | 10/1995 | Pugh | |
| 5,839,972 | A | 11/1998 | Swanson | |
| 5,857,927 | A | 1/1999 | Driscoll et al. | |
| 5,899,511 | A | 5/1999 | Dinatale | |
| 6,817,955 | B2 | 11/2004 | O'Donnell et al. | |
| 2005/0170904 | A1 * | 8/2005 | Smeeth | 473/286 |
| 2006/0025230 | A1 * | 2/2006 | Zeuch | 473/286 |
| 2006/0058109 | A1 * | 3/2006 | Wilson, III | 473/286 |

* cited by examiner

*Primary Examiner*—Stephen Blau
(74) *Attorney, Agent, or Firm*—Walter W. Duft

(57) ABSTRACT

A golf ball teeing device includes a base adapted to mount to a golf club grip end and a ball carrier on the base. The ball carrier is positionable between an operational position for carrying a golf ball and a stowage position wherein a golf club on which the golf ball teeing device is mounted may be used to make a golf shot. During use, a golfer positions the ball carrier in the operational position and places a golf ball thereon. Using the golf ball teeing device, the golfer places the golf ball on a golf tee, then disengages the ball carrier and positions it in the stowage position. A self-righting golf tee may be used with the golf ball teeing device so that the golfer is not required to bend down to the ground at any time during the teeing operation. The self-righting golf tee may be tossed on the ground and tamped as necessary (e.g., using the golf club) to place it in a stable golf ball-receiving position. Optionally, the ball carrier of the golf ball teeing device may thereafter be used to retrieve the golf tee.

20 Claims, 14 Drawing Sheets

GOLF BALL TEEING DEVICE

BACKGROUND OF THE INVENTION

1. Field of the Invention

The present invention relates to the field of golfing, and more particularly to golf ball teeing devices.

2. Description of Prior Art

Golf ball teeing devices have been proposed that allow a golfer to tee a golf ball without having to bend the back or knees, as is required when manually teeing a golf ball. It is to improvements in such devices that the present invention is directed. What is particularly needed is a teeing device that does not have to be repeatedly attached and detached from a golf club, which is unobtrusive when not in use, and which allows the tee to be conveniently retrieved following a drive.

SUMMARY OF THE INVENTION

The foregoing problems are solved and an advance in the art is achieved by a golf ball teeing device that includes a base adapted to mount to a golf club grip end and a ball carrier on the base. The ball carrier is positionable between an operational position for carrying a golf ball and a stowage position wherein a golf club on which the teeing device is mounted may be used to make a golf shot. During use, a golfer positions the ball carrier in the operational position and places a golf ball thereon. Using the teeing device, the golfer places the golf ball on a golf tee, then disengages the ball carrier and positions it in the stowage position. A self-righting golf tee may be used with the teeing device so that the golfer is not required to bend down to the ground at any time during the teeing operation. The self-righting golf tee may be tossed on the ground and tamped as necessary (e.g., using the golf club) to place it in a stable golf ball-receiving position. Optionally, the ball carrier of the teeing device may thereafter be used to retrieve the golf tee.

BRIEF DESCRIPTION OF THE DRAWINGS

The foregoing and other features and advantages of the invention will be apparent from the following more particular description of exemplary embodiments, as illustrated in the accompanying Drawings in which.

DETAILED DESCRIPTION OF EXEMPLARY EMBODIMENTS

Figure 1:
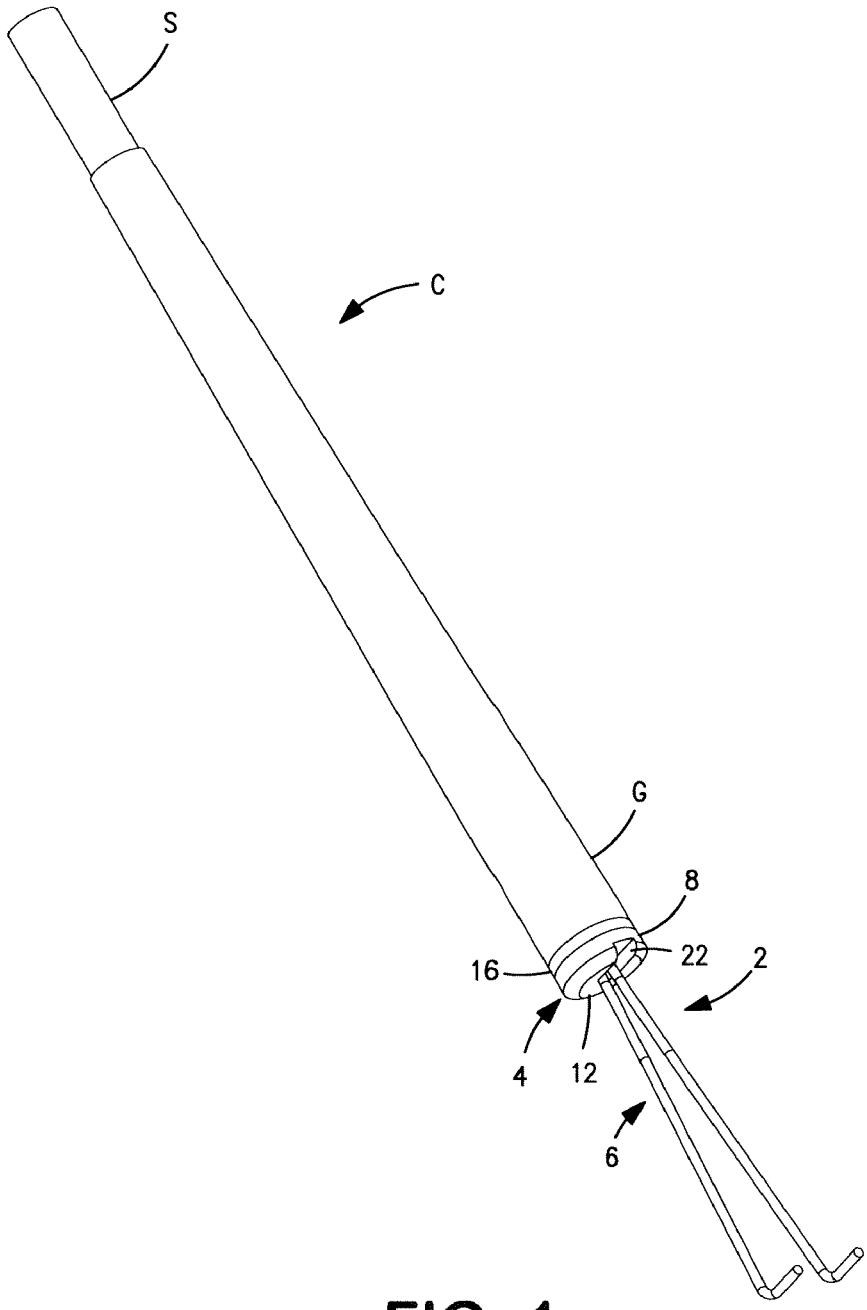
FIG. 1 is a perspective view showing an exemplary golf ball teeing device mounted on a golf club and in an operational position.
Figure 2:
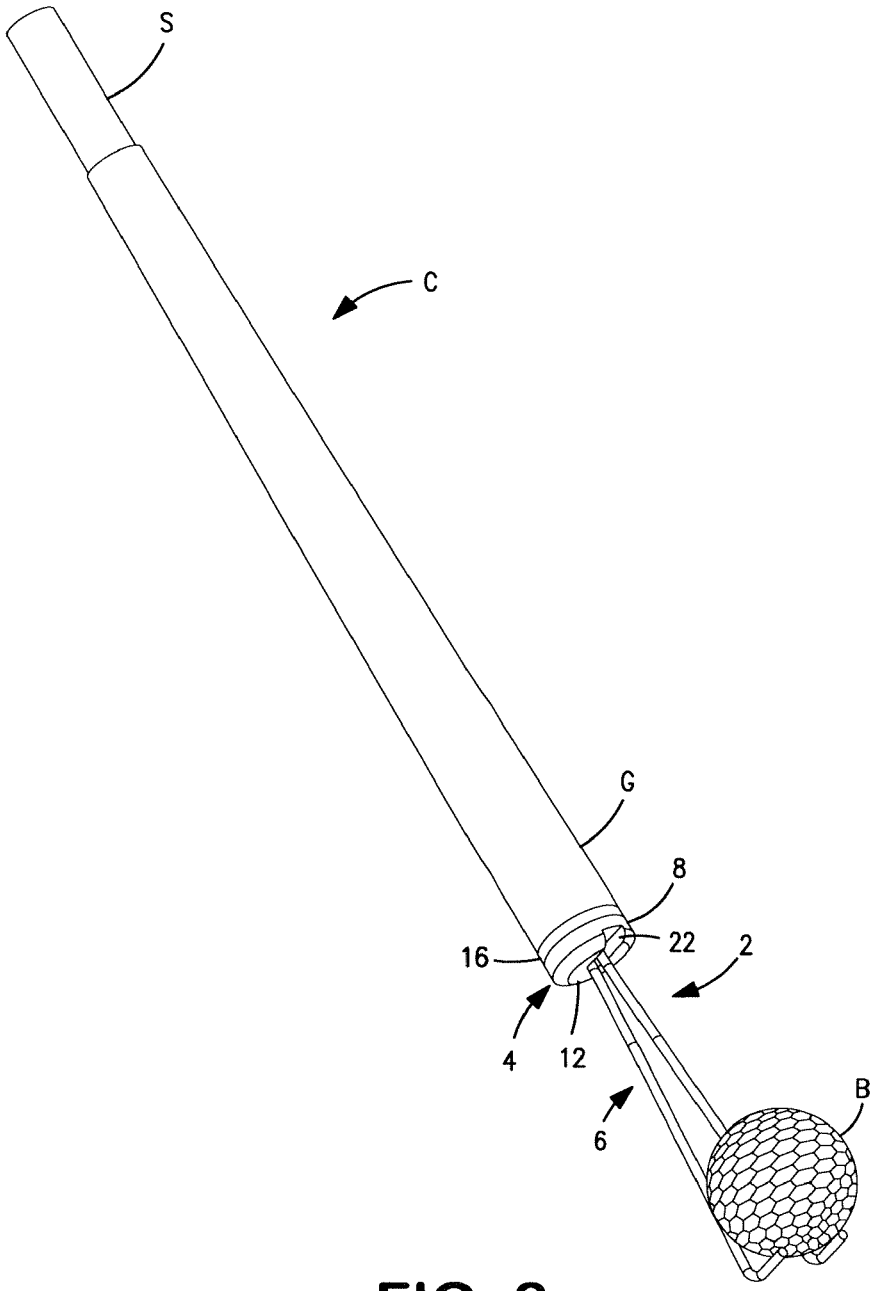
FIG. 2 is a perspective view showing the golf ball teeing device of FIG. 1 in the operational position holding a golf ball.
Figure 3:
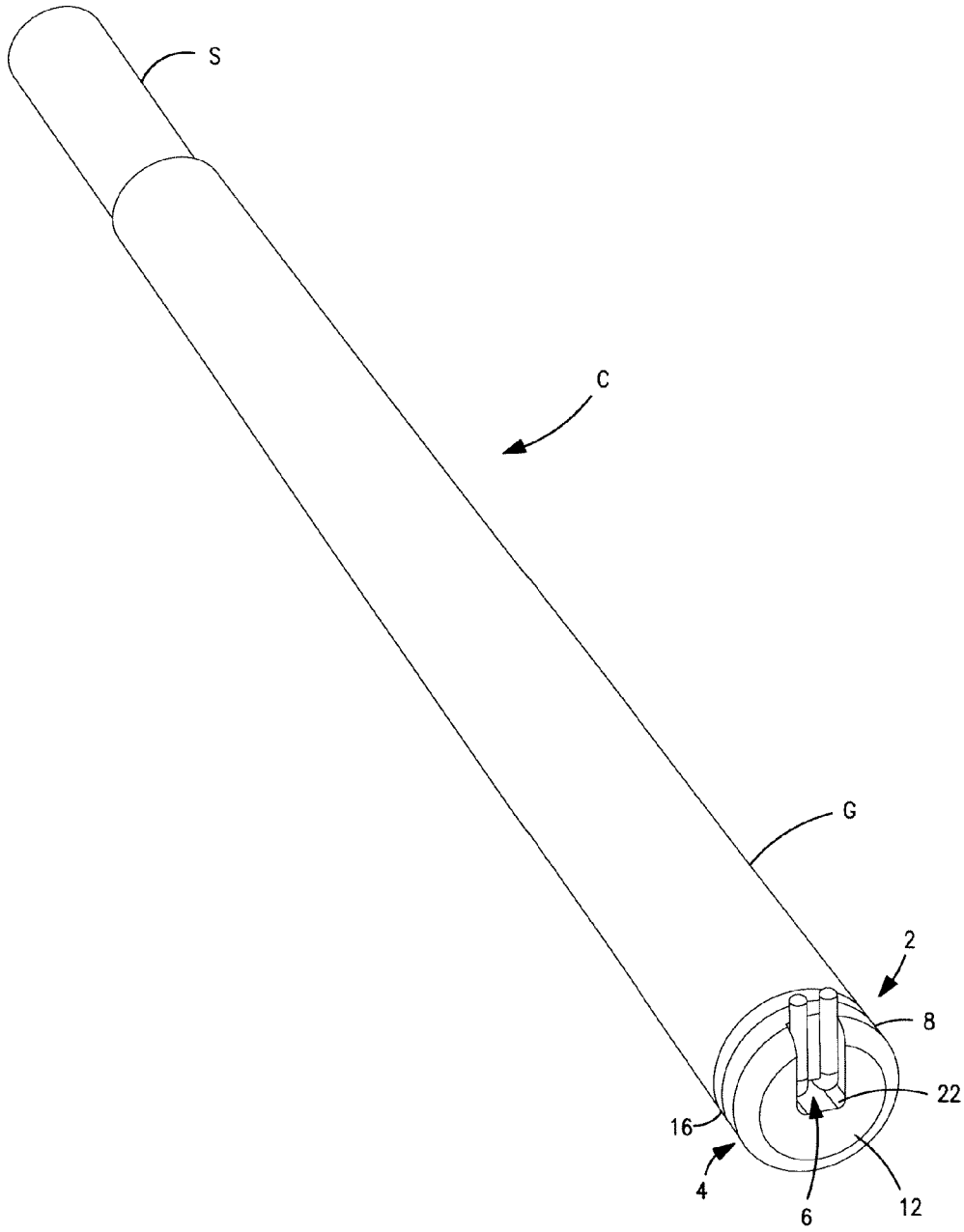
FIG. 3 is a perspective view showing the golf ball teeing device of FIG. 1 in a stowage position.

Turning now to the drawings wherein like reference numerals indicate like elements in all of the several views, FIG. 1 illustrates an exemplary golf ball teeing device 2 having a base 4 and a ball carrier 6 on the base. The base 4 is adapted to mount to the grip end of a golf club, such as the end of the club "C" where the head of the grip "G" terminates. As additionally shown in FIGS. 2-3, the ball carrier 6 is positionable between an operational position (FIGS. 1-2) for carrying a golf ball "B" (FIG. 2) and a stowage position (FIG. 3) wherein the golf club "C" on which the teeing device 2 is mounted may be used to make a golf shot. In the embodiment of FIGS. 1-3, the ball carrier 6 is slideably positional relative to the base 4. Other positioning methods could potentially also be used, such as folding, collapsing, bending or the like, depending on how the ball carrier 6 and the base 4 are constructed.

Figure 4:
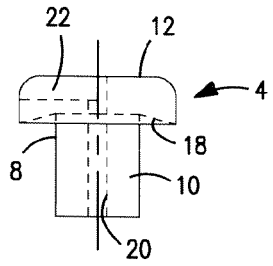
FIG. 4 is a side elevational view showing a base of the golf ball teeing device of FIG. 1.
Figure 5:
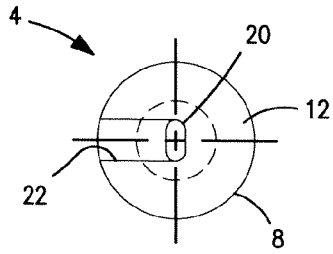
FIG. 5 is a plan view showing the base of FIG. 4.
Figure 6:
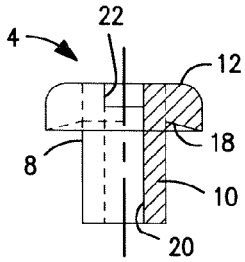
FIG. 6 is a partial cross-sectional side view showing the base of FIG. 4.

Turning now to FIGS. 4-6, the base 4 may be constructed as a holder plug 8 made from a durable compressible material, such as a polymer or the like. As can be additionally seen in FIGS. 9-12, the holder plug 8 includes a neck 10 adapted to be received within the butt of the golf club shaft "S" and a cap 12 adapted to cover the shaft butt. The neck 10 may be sized so that its outside diameter is slightly larger than the inside diameter of the shaft "S," thereby allowing the holder plug 8 to be secured to the shaft by way of an interference fit. As also shown in FIGS. 9-12, the neck 10 may be optionally provided with gripping members 14, such as serrations or threads, that provide additional assistance in securing the neck to the shaft "S." An adhesive material could also be used to create an adhesive bond between the neck 10 and the shaft "S."

As further shown in FIGS. 9-12, an optional shim 16 (such as a washer) may be placed on the neck 10 of the holder plug 8 to ensure there is no gap between the underside of the cap 12 and the opposing annular end face of the grip "G." The shim 16 is helpful when retrofitting an existing golf club with the teeing device 2. As described in more detail below, when the original end of the grip "G" is removed to expose the butt of the shaft "S", there may be a portion of the shaft extending beyond the grip end face. Although the underside of the cap 12 may be formed with a concavity 18 (FIGS. 4 and 6) that is adapted to receive and thereby cover the exposed portion of the shaft "S," the shim 16 may be used when the concavity 18 is not deep enough in order to fill any remaining gap between the cap and the end face of the grip "G."

As best shown in FIGS. 4-6, the holder plug 8 further includes a central longitudinally extending bore 20 for slideably receiving the ball carrier 6. The bore 20 may extend through the entirety of the cap 8 and the neck 10, and may be elongated in one dimension to accommodate carrier arm portions of the ball carrier 6 (see below). The holder plug 8 additionally includes a transverse slot 22 formed in the top of the cap 12. The slot 22 extends from the bore 20 to the cap's outer radius. The slot 22 accommodates carrier arm members of the ball carrier 6 (see below).

Figure 7:
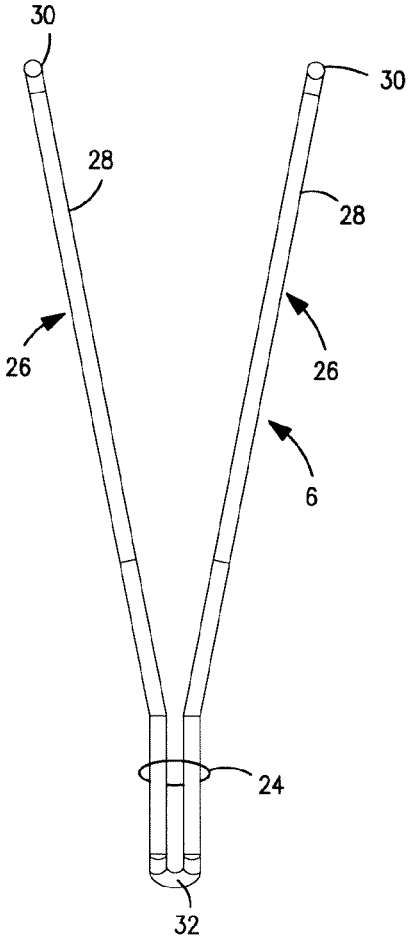
FIG. 7 is a front elevational view showing a ball carrier of the golf ball teeing device of FIG. 1.
Figure 8:
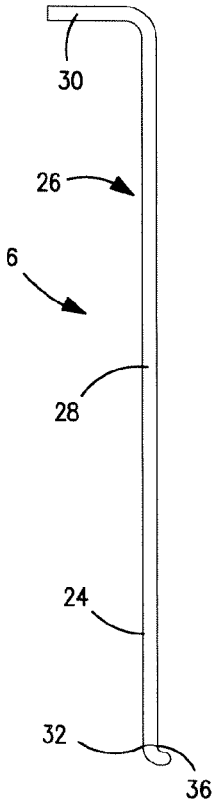
FIG. 8 is a side elevational view showing the ball carrier of FIG. 7.

Turning now to FIGS. 7 and 8, the ball carrier 6 may include a shank 24 and a pair of carrier arms 26. The carrier arms 26 may each include a stem 28 extending from the shank 24 and a ball carrying member 30 extending from the stem at an angle (such as 90 degrees). The ball carrier 6 may be constructed in a variety of ways. FIGS. 7 and 8 show one example in which the ball carrier 6 is formed as a holder spring made of a suitable resilient biasing material, such as heavy gauge stainless steel wire. The holder spring can be shaped by folding a length of the spring material at its midpoint to form a 180 degree bend 32 that defines the shank 24.

Figure 7A:
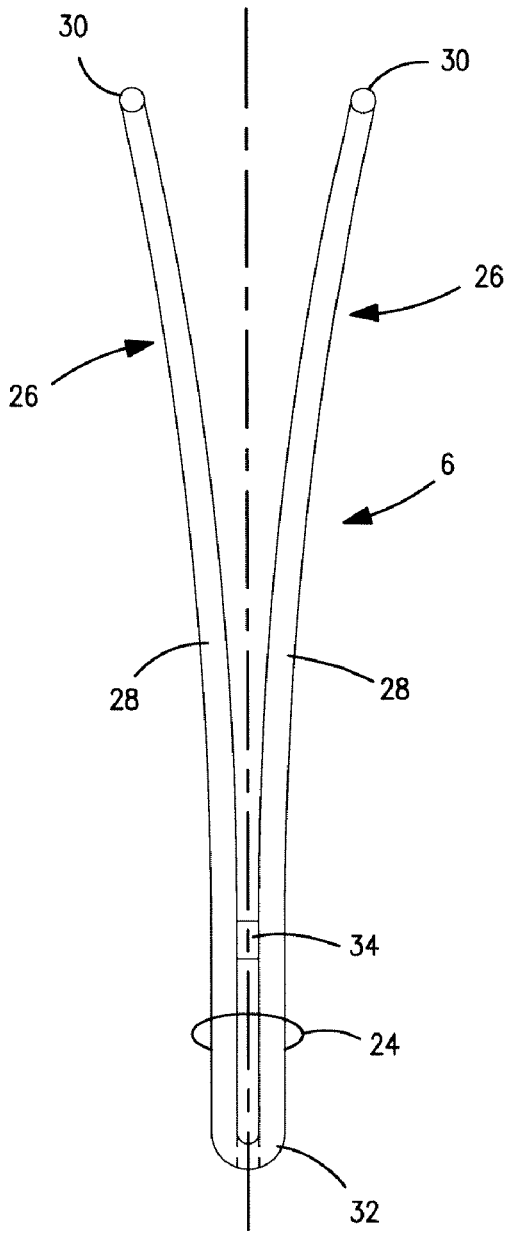
FIG. 7A is a front elevational view showing a modified construction of the ball carrier of FIG. 7.

Optionally, the bend 32 can be maintained by welding the spring material at 34, as shown in FIG. 7A. However, the weld 34 should not be needed in most cases. The free ends of the spring material may then be bent to define the ball carrier members 30. As further shown in FIGS. 9-12, an additional out-of-plane bend may be formed at the base of the shank 24 to provide a stop 36 that prevents the ball carrier 6 from being pulled out of the plug holder 4 when the ball carrier is extended from its stowed position (shown in FIGS. 11 and 12) to its operational position (shown in FIGS. 9 and 10). The stop 36 may be formed either prior to or after sliding the shank 24 through the bore 20 of the holder plug 8. As an alternative to providing the stop 36, the bore 20 of the holder plug 8 could be formed with a central blocking member (not shown). The blocking member could have individual bores that slideably receive the carrier arm stems 28, but would stop movement of the ball carrier 6 when contacted by the weld 34 (or the bend 32 if the weld is not present).

Figure 9:
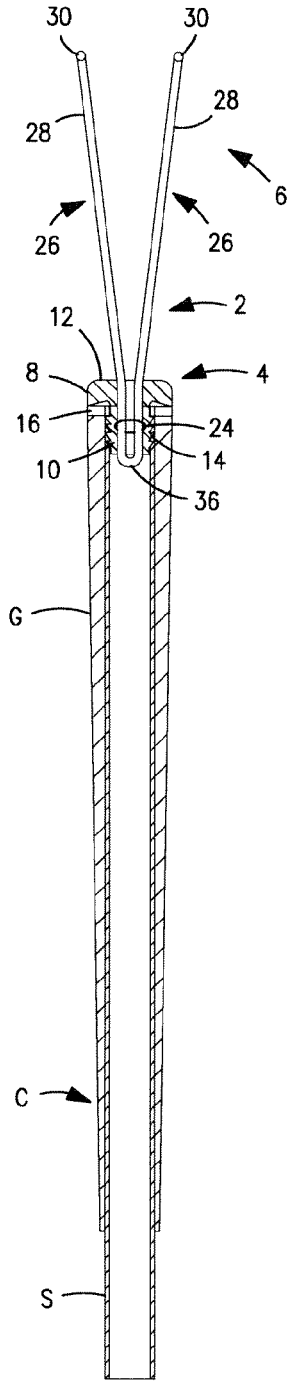
FIG. 9 is a front cross-sectional centerline view showing the golf ball teeing device of FIG. 1 in the operational position.
Figure 10:
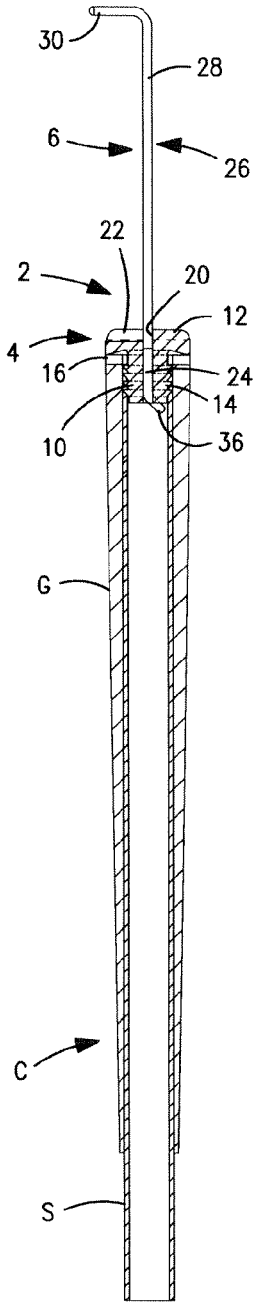
FIG. 10 is a side cross-sectional centerline view showing the golf ball teeing device of FIG. 1 in the operational position.
Figure 11:
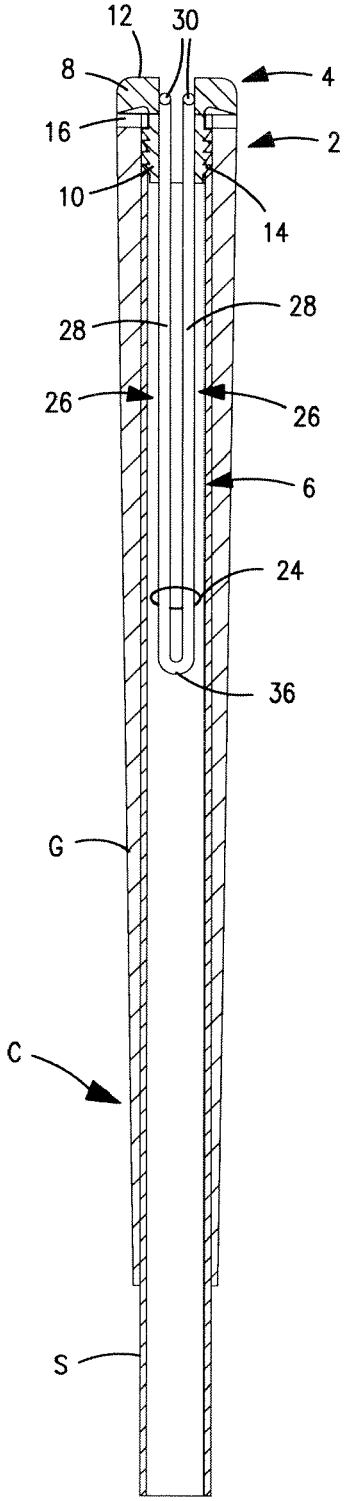
FIG. 11 is a front cross-sectional centerline view showing the golf ball teeing device of FIG. 1 in the stowage position.
Figure 12:
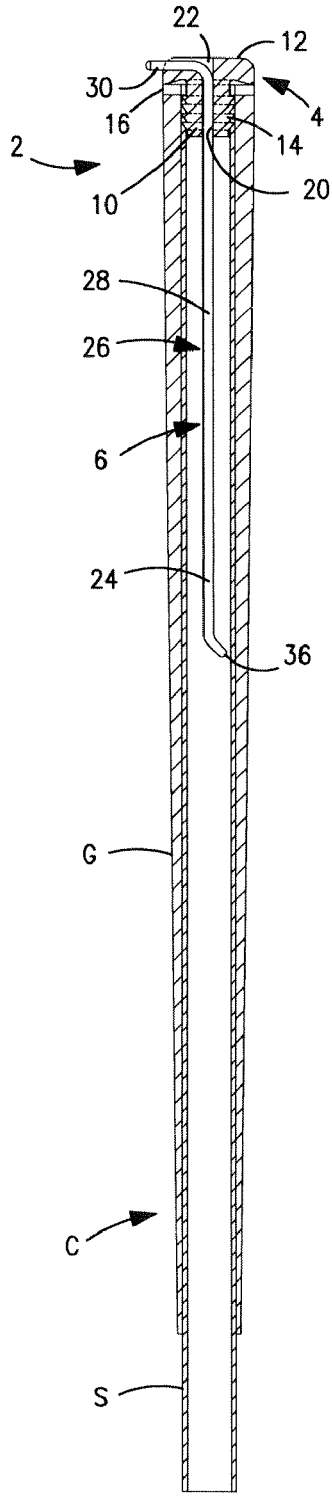
FIG. 12 is a side cross-sectional centerline view showing the golf ball teeing device of FIG. 1 in the operational position.

As shown in FIGS. 9 and 10, when the ball carrier 6 is in its extended operational position, the ball carrying members 30 will separate from each other due to the spring action of the carrier arm stems 28 when freed from the longitudinal bore 20 of the holder plug 8. For improved ball carrying stability, the separation distance is preferably at least one-half the diameter of a golf ball. Other separation distances may also be used. As shown in FIGS. 11 and 12, when the ball carrier 6 is placed in the stowage position, the ball carrying members 30 will be substantially adjacent to each other and substantially disposed within the base 4, due to the squeezing action of the longitudinal bore 20 of the holder plug 8 on the carrier arms 26. In particular, the ball carrying members 30 will be seated in the transverse slot 22 formed in the holder plug's cap 12. Due to this stowage positioning, the golf club "C" may be used in conventional fashion to make a golf shot without interference from the teeing device 2. Advantageously, the teeing device 2 thus does not have to be removed from the golf club "C" following teeing (although this could be optionally done if desired).

Figure 13A:
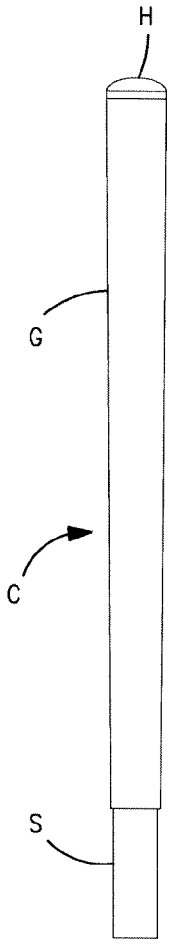
FIG. 13A is side elevational view showing a golf club to which the golf ball teeing device of FIG. 1 is to be mounted.
Figure 13B:
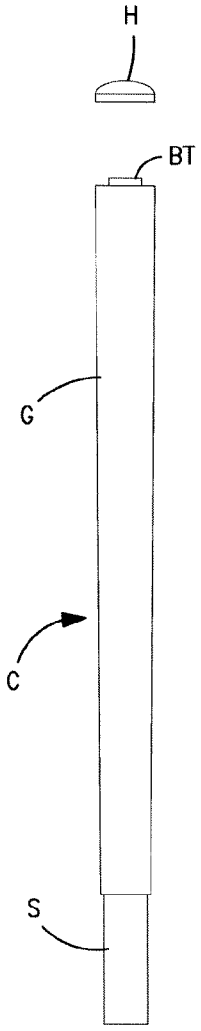
FIG. 13B is side elevational view showing the golf club of FIG. 13A following removal of the head portion of the golf club handle.
Figure 13C:
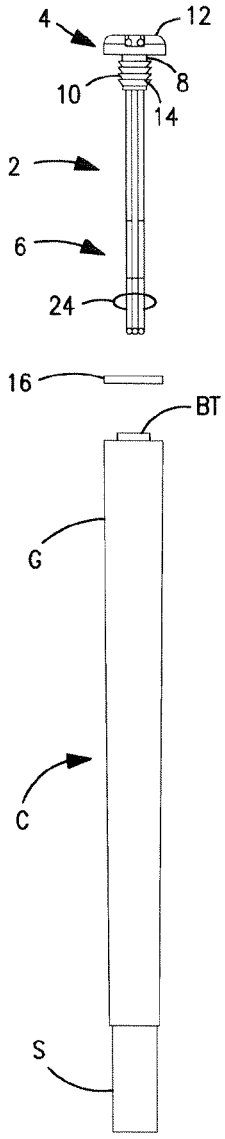
FIG. 13C is side elevational view showing the golf club of FIG. 13A during mounting of the golf ball teeing device of FIG. 1.

Turning now to FIGS. 13A-13C, the teeing device 2 may be mounted to the golf club "C" using a retrofitting operation. According to this operation, which begins in FIG. 13A, the head "H" of the club's grip "G" is removed, as by using a sharp instrument such as a knife or saw. The removal of the grip material exposes the butt "BT" of the shaft "S," as shown in FIG. 13B. The shim 16, if used, is now mounted over the shaft butt "BT," as shown in FIG. 13C. As also shown in FIG. 13C, the shank 24 of the ball carrier 6 is then inserted into the hollow interior of the shaft "S" until the neck 10 of the holder plug 8 contacts the shaft butt "BT." The holder plug 8 may then be pressed or tapped down until the bottom of the cap 12 (at the base of the neck 10) seats on the shaft butt "BT." In this position, the outer edges of bottom of the cap 12 should contact the shim 16. If they do not, additional shimming may be required.

Figure 14A:
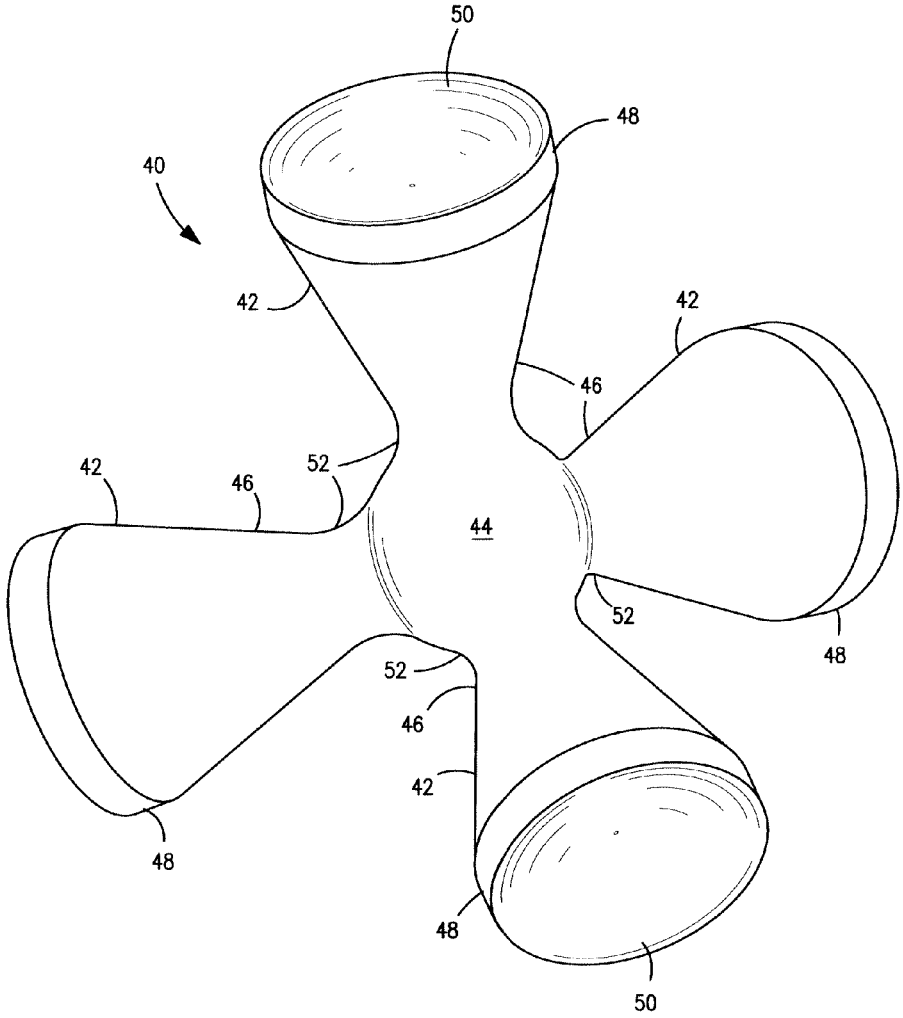
FIG. 14A is a perspective view showing a self-righting golf tee that may be used with the golf ball teeing device of FIG. 1.
Figure 15C:
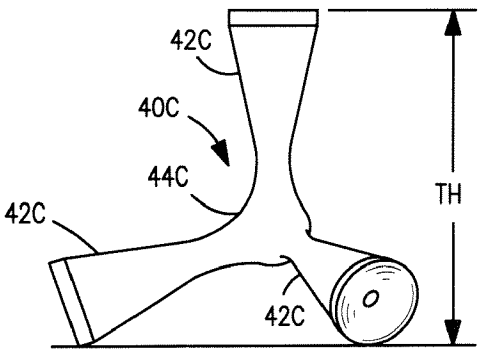
FIG. 15C is a side elevational view showing the self-righting golf tee of FIG. 14C.
Figure 15B:
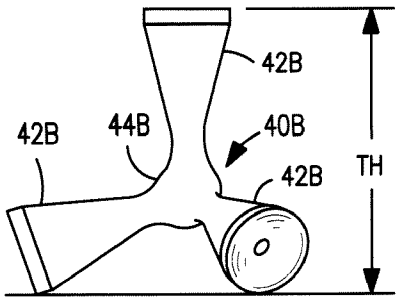
FIG. 15B is a side elevational view showing the self-righting golf tee of FIG. 14B.
Figure 15A:
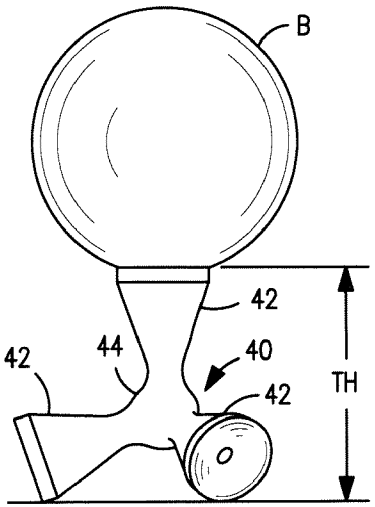
FIG. 15A is a side elevational view showing the self-righting golf tee of FIG. 14A supporting a golf ball.

Turning now to FIGS. 14A and 15A, the teeing device 2 may be used with a self-righting tee 40 in order to minimize the amount of effort required by a golfer to tee a golf ball. The tee 40 may include plural golf ball supporting pedestals 42, for example, four pedestals that are equally angularly spaced from each other. The pedestals 42 may extend from a central hub 44 that is generally spherical in shape, but which could alternatively have any other desired shape. The pedestals 42 may be generally frustoconical in shape, with the narrow end 46 of the frustocone being affixed to the pedestal 42 and the wide end 48 of the frustocone defining a cup 50 that supports a golf ball "B" (see FIG. 15A) during a golf shot. Optional fillets 52 may be formed between the frustocone narrow ends 46 and the hub 44 in order to provide a smooth rounded transition between the hub and the pedestals 42.

The respective longitudinal axes of the pedestals 42 may be angularly separated from each other by an angle of approximately 109.5 degrees. When this geometry is used, one of the pedestals 42 will always be perpendicular to the plane of contact between the three remaining pedestals and a support surface on which the other three pedestals are in contact. As a result, when three of the pedestals 42 are in contact with level ground, the remaining pedestal will point vertically upwardly. Moreover, the hub 44 will be located at the center of gravity of the tee 40. This means that each pedestal 42 should have a statistically equal chance of being the vertical pedestal when the tee is tossed on the ground.

The tee 40 can be constructed using any suitable manufacturing technique, including injection molding, machining, etc. The tee 40 may be formed as an integral whole or it could be assembled from discrete components. For example, the central hub 44 could be formed as one component and the pedestals 42 could be separately mounted thereto as additional components. To facilitate such mounting, the central hub 44 could be formed with bores and the pedestals 42 could be formed with posts that seat in the bores. An adhesive could be used to secure the posts in the bores. Alternatively, the bores and posts could be threaded to provide a threaded connection. If desired, central hub 44 may optionally comprise a magnetically attractive material so that the tee 40 can be retrieved by a magnetized tee retriever. The magnetically attractive material may comprise a metal object (e.g., a steel ball) disposed within the hub 44, or if desired, by making the entire hub out of metal. The remainder of the tee may be constructed from wood, a polymer plastic, or other suitable material.

Figure 14B:
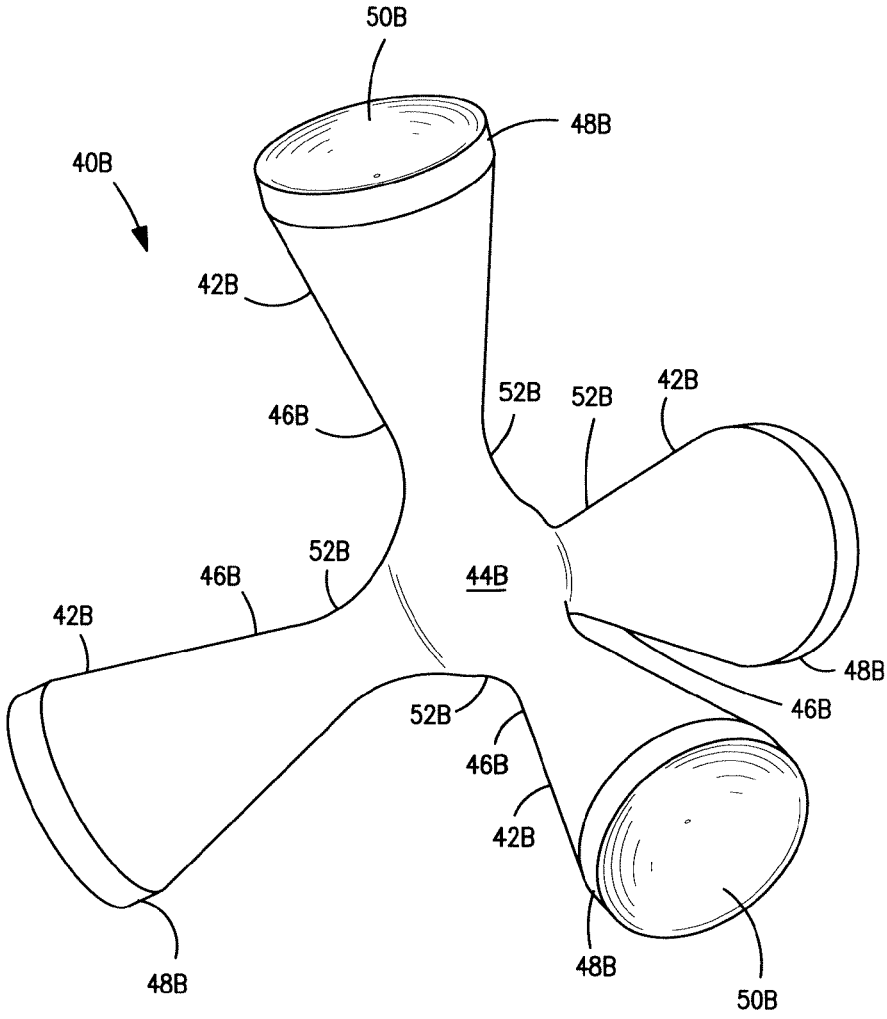
FIG. 14B is a perspective view showing the self-righting golf tee of FIG. 14A in a larger size.
Figure 14C:
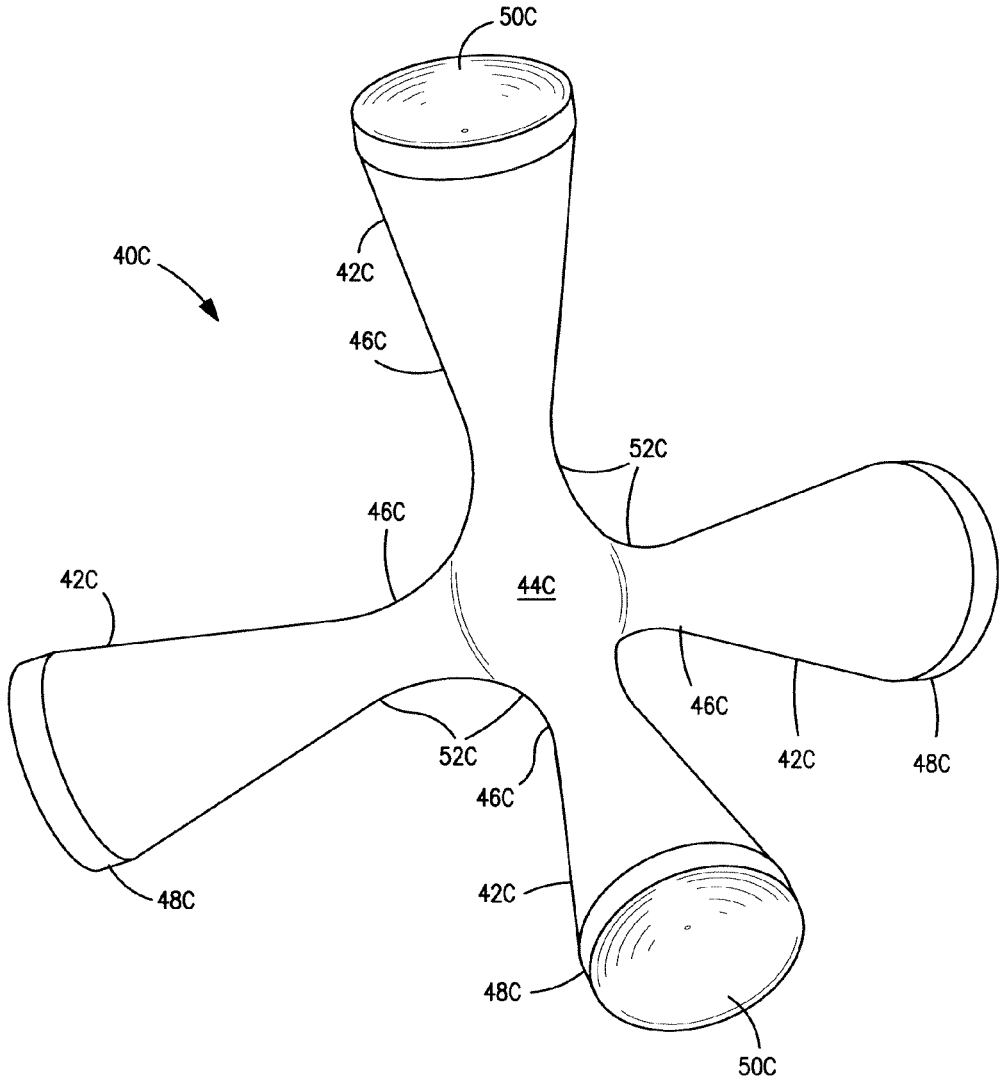
FIG. 14C is a perspective view showing the self-righting golf tee of FIG. 14A in a still larger size.

The tee 40 may be manufactured in different sizes to provide a range of tee heights. FIGS. 14A and 15A show a nominal size version of the tee 40. FIGS. 14B and 15B show a tee 40A that is larger in size than the nominal tee 40. FIGS. 14C and 15C show a tee 40C that is larger in size than the tee 40B. FIGS. 15A, 15B and 15C illustrate the difference in tee height "TH" between the tees 40, 40B and 40C, where "TH" is the distance from the ground to the top of the vertically-extending pedestal 42, 42B or 42C. By way of example only, the height "TH" in FIG. 15A could be 1.5 inches, the height "TH" in FIG. 15B could be 1.75 inches, and the height "TH" in FIG. 15C could be 2.0 inches. Other sizes could also be provided. Apart from their size, the tees 40B and 40C are identical in all respects to the tee 40, as shown by the use of corresponding reference numbers. As such, the above description of the tee 40 applies equally to the tees 40B and 40C, and need not be repeated relative to FIGS. 14B/15B and 14C/15C.

During use, a golfer tosses or drops the tee 40 onto the ground. As stated, the tee 40 will orient itself with three of the pedestals 42 contacting the ground and the remaining pedestal protruding upwardly to receive a golf ball. In the event that the turf on ground causes the upright pedestal 42 to tilt, the golfer can place his or her foot on the tee 40 to level it, or alternatively may use the head of a golf club to tamp the tee into a stable position.

Figure 16:
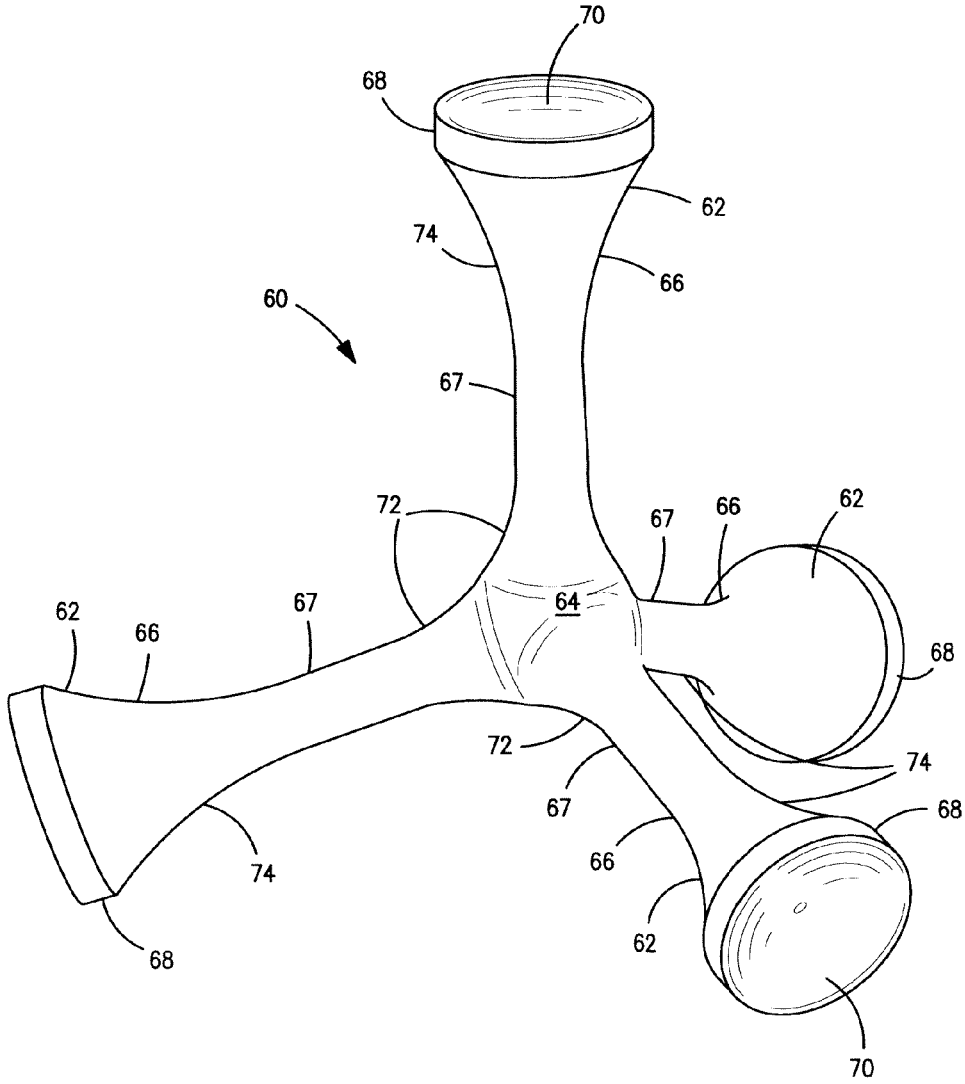
FIG. 16 is a perspective view showing a modified self-righting golf tee that may be used with the golf ball teeing device of FIG. 1.

Turning now to FIG. 16, a modified self-righting tee 60 is shown. The tee 60 is similar to the tees 40, 40B and 40C described above, except that the narrow end 66 of the pedestal frustocone is connected to the hub 64 via a slender cylindrical stem 67. This reduces the weight of the tee 60 and gives it a less bulky appearance than the tees 40, 40B and 40C. To further reduce the bulk and weight of the tee 60, the size of the hub 64 may be reduced as desired. In some cases, the hub 64 could be reduced in size to the diameter of the stems 67, such that the stems (or the pedestals) appear to be centrally joined together without a distinct hub. If the hub 64 is larger than the stem diameter, a fillet 72 may be formed between the hub and the stems 67 in order to provide a smooth rounded transition between the hub and the stems. A fillet 74 may also be formed between the stems 67 and the frustocone narrow ends 66 of the pedestals 62 in order to provide a smooth rounded transition between the stems and the pedestals. As in the case of the tees 40, 40B and 40C, the tee 60 may be fabricated in different sizes to provide different teeing heights.

Figure 17A:
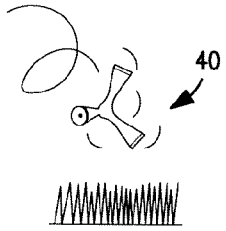
FIG. 17A is a perspective view showing a first stage of deployment of the self-righting golf tee of FIG. 14A.
Figure 17B:
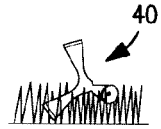
FIG. 17B is a perspective view showing a second stage of deployment of the self-righting golf tee of FIG. 14A.
Figure 17C:
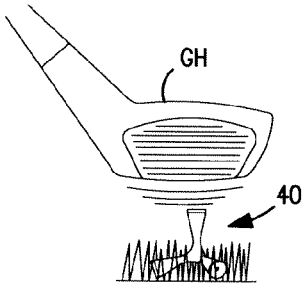
FIG. 17C is a perspective view showing a third stage of deployment of the self-righting golf tee of FIG. 14A.
Figure 17D:
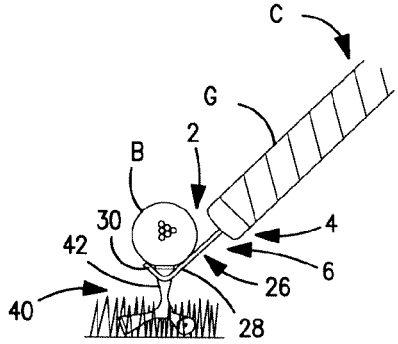
FIG. 17D is a perspective view showing placement of a golf ball on the golf tee of FIG. 14A using the golf ball teeing device of FIG. 1.
Figure 17E:
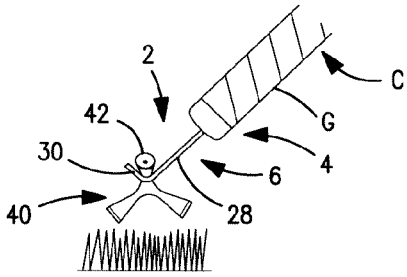
FIG. 17E is a perspective view showing retrieval of the golf tee of FIG. 14A using the golf ball teeing device of FIG. 1 following a golf shot.

Turning now to FIGS. 17A-E, an exemplary golf ball teeing technique using the teeing device 2 and the self-righting tee 40 is illustrated. FIG. 17A shows a first stage of deployment of the tee 40 in which the tee has been tossed or dropped toward the ground by a golfer. FIG. 17B shows a second stage of deployment of the tee 40 wherein the tee has landed on the ground. Due to the turf growing on the ground, the upright pedestal 42 of the tee 40 may be tilted from vertical. As indicated above, the tee 40 can be leveled by the golfer using his/her foot or by tamping the tee with a golf club. FIG. 17C illustrates a third stage of deployment of the tee 40 wherein the tee 40 is tamped using the bottom of the golf club head "GH." FIG. 17D shows the placement of a golf ball "B" onto the tee 40 using the teeing device 2. Prior to ball placement, the golfer will have positioned the ball carrier 6 in its extended operational position, inverted the golf club "C" so that the ball carrier is facing downwardly, and placed the golf ball "B" in the cup defined by the stems 28 and ball carrying members 30 of the carrier arms 26. Using the teeing device 2, the golfer gently places the golf ball "B" on the upright pedestal 42 of the golf tee 40, then disengages the ball carrier 6 by maneuvering it downwardly and way from the ball. The ball carrier 6 may then be returned to its stowage position and the golf club "C" may be used in conventional fashion to drive the golf ball "B" off the tee 40. As shown in FIG. 17E, the tee 40 may be retrieved using the teeing device 2. The golfer simply needs to extend the ball carrier 6 to its operational position, invert the golf club "C" and pick up the tee 40 by using the carrier arms 26 to hook one or more of the pedestals 42. Although not shown, this can be facilitated by turning the golf club "C" so that the ball carrying members 30 are oriented generally horizontally, and then maneuvering the carrier arms 26 into engagement with the tee 40, rotating the ball carrying members to a vertical position to cradle the tee and lifting the club. Tee retrieval may also be accomplished by pointing the ball carrier 6 downwardly while in its operational position over the tee 40, so that the ball carrier straddles the upright pedestal 42. The teeing device 2 may then be pushed downwardly such that the ball carrier 6 engages the tee 40 and retracts to its stowage position. In doing so, the ball carrier 6 will act as a pair of tweezers to pinch the upright pedestal 42 and thereby capture the tee 40.

Accordingly, a golf ball teeing device has been disclosed that allows a golfer to tee a golf ball without bending the back or knees, and which allows a tee to be conveniently retrieved following a drive. It should, of course, be understood that the description and the drawings herein are merely illustrative, and it will be apparent that various modifications, combinations and changes can be made in accordance with the invention. For example, although the teeing device 2 is shown being used with the self-righting tee 40, it may be also used with conventional golf tees. However, the golfer will then be required to insert the tee in the ground and thereafter retrieve it in conventional fashion. As such, the invention is not to be in any way limited except in accordance with the spirit of the appended claims and their equivalents.

What is claimed is:

1. A golf ball teeing device, comprising:

a base adapted to mount to a golf club grip end;

said base comprising a holder plug having a neck adapted to be received within a golf club shaft bore and a cap at one end of said neck adapted to cover a butt of said golf club shaft;

said holder plug comprising a bore extending longitudinally through the entirety of said neck and said cap;

said holder plug further comprising a transverse slot formed in a top of said cap, said transverse slot extending transversely from said longitudinal bore;

a ball carrier on said base, said ball carrier having an elongated longitudinal portion disposed in said longitudinal bore and a relatively short transverse portion adapted to seat in said transverse slot and extending at an angle to said longitudinal portion to form a ball carrying cup; and said ball carrier being positionable between an operational position wherein said transverse portion is removed from said transverse slot and said longitudinal portion extends from said golf club shaft bore so that said ball carrying cup is exposed for carrying a golf ball and a stowage position wherein said transverse portion is substantially disposed in said transverse slot and said longitudinal portion is fully disposed within said golf club shaft bore, and a golf club on which the golf ball teeing device is mounted is able to be used to make a golf shot and a handle on said golf club is fully accessible for gripping.

2. A golf ball teeing device in accordance with claim 1 wherein said neck on said holder plug comprises gripping members for gripping a golf club shaft bore.

3. A golf ball teeing device in accordance with claim 1 wherein said ball carrier is slideably disposed in said base.

4. A golf ball teeing device in accordance with claim 1 wherein said ball carrier comprises a shank and a pair of carrier arms.

5. A golf ball teeing device in accordance with claim 4 wherein said carrier arms each comprise a stem extending from said shank and a ball carrying member extending from said stem at an angle.

6. A golf ball teeing device in accordance with claim 5, wherein said ball carrying members of said carrier arms are separated from each other by a distance that is at least one-half the diameter of a golf ball when said ball carrier is in said operational position.

7. A golf ball teeing device in accordance with claim 5 wherein said ball carrying members are substantially adjacent to each other and substantially stowed in said base when said ball carrier is in said stowage position.

8. A golf ball teeing device in accordance with claim 5 wherein said stems of said carrier arms comprise a resilient material that biases said ball carrying members to a separated position.

9. A golf club and golf ball teeing device, comprising:

a golf club having a head end and a grip end;

a base mounted to said golf club grip end;

said base comprising a holder plug having a neck adapted to be received within a golf club shaft bore and a cap at one end of said neck adapted to cover a butt of said golf club shaft;

said holder plug comprising a bore extending longitudinally through the entirety of said neck and said cap;

said holder plug further comprising a transverse slot formed in a top of said cap, said transverse slot extending transversely from said longitudinal bore;

a ball carrier on said base, said ball carrier having an elongated longitudinal portion disposed in said longitudinal bore and a relatively short transverse portion adapted to seat in said transverse slot and extending at an angle to said longitudinal portion to form a ball carrying cup; and said ball carrier being positionable between an operational position wherein said transverse portion is removed from said transverse slot and said longitudinal portion extends from said golf club shaft bore so that said ball carrying cup is exposed for carrying a golf ball and a stowage position wherein said transverse portion is substantially disposed in said transverse slot and said longitudinal portion is fully disposed within said golf club shaft bore, and said golf club on which the golf ball teeing device is mounted is able to be used to make a golf shot and a handle on said golf club is fully accessible for gripping.

10. A golf club and golf ball teeing device in accordance with claim 9 wherein said neck on said holder plug comprises gripping members for gripping a golf club shaft bore.

11. A golf club and golf ball teeing device in accordance with claim 9 wherein said ball carrier is slideably disposed in said base.

12. A golf club and golf ball teeing device in accordance with claim 9 wherein said ball carrier comprises a shank and a pair of carrier arms.

13. A golf club and golf ball teeing device in accordance with claim 12 wherein said carrier arms each comprise a stem extending from said shank and a ball carrying member extending from said stem at an angle.

14. A golf club and golf ball teeing device in accordance with claim 13, wherein said ball carrying members of said carrier arms are separated from each other by a distance that is at least one-half the diameter of a golf ball when said ball carrier is in said operational position.

15. A golf club and golf ball teeing device in accordance with claim 13 wherein said ball carrying members are substantially adjacent to each other and substantially stowed in said base when said ball carrier is in said stowage position.

16. A golf club and golf ball teeing device in accordance with claim 13 wherein said stem of said carrier arms comprise a resilient material that biases said ball carrying members to a separated position.

17. A golf club and golf ball teeing device, comprising:

a golf club having a head end, a grip end and an elongated shaft having a shaft bore;

a base mounted to a butt of said golf club shaft at said golf club grip end;

said base comprising a holder plug having a neck adapted to be received within said golf club shaft bore and a cap at one end of said neck adapted to cover said golf club shaft butt;

said holder plug comprising a bore extending longitudinally through the entirety of said neck and said cap, said holder plug longitudinal bore having first and second cross-sectional dimensions, with said first dimension being larger than said second dimension;

said holder plug further comprising a transverse slot formed in a top of said cap, said transverse slot extending transversely from said holder plug longitudinal bore;

a ball carrier on said base, said ball carrier having an elongated longitudinal portion disposed in said longitudinal bore and a relatively short transverse portion adapted to seat in said transverse slot and extending at an angle to said longitudinal portion to form a ball carrying cup;

said ball carrier longitudinal portion being formed as a spring element made of a resilient biasing material folded upon itself at its midpoint to form a generally U-shaped shank and bent at said shank to form a pair of generally V-shaped carrier arms;

said ball carrier transverse portion comprising a pair of ball carrier members formed as bent free ends of said carrier arms, with said ball carrying cup being a region between said ball carrier members and said carrier arms;

said ball carrier being positionable between an operational position wherein said ball carrier members are removed from said transverse slot and said carrier arms extend from said golf club shaft bore so that said ball carrying cup is exposed for carrying a golf ball and a stowage position wherein said ball carrier members are substantially disposed in said transverse slot and said carrier arms are fully disposed within said golf club shaft bore, and wherein said golf club on which the golf ball teeing device is mounted is able to be used to make a golf shot and a handle on said golf club is fully accessible for gripping; and said carrier arms having a cross sectional size that corresponds to said second dimension of said holder plug longitudinal bore, and said carrier arms having a spacing at said free ends thereof that is larger than said first dimension of said holder plug longitudinal bore such that said carrier arms are squeezed together by said holder plug longitudinal bore in said stowage position.

18. A golf club and golf ball teeing device in accordance with claim 17 wherein said holder plug longitudinal bore is centrally located in said holder plug.

19. A golf club and golf ball teeing device in accordance with claim 18 wherein said holder plug transverse slot extends from said longitudinal bore to a side of said holder plug cap and comprises a single slot that accommodates both of said ball carrier members.

20. A golf club and golf ball teeing device in accordance with claim 19 wherein said ends of said ball carrier members protrude beyond said side of said holder plug cap when said ball carrier is in said stowage position in order to be grasped and pulled out of said transverse slot to said operational position.

* * * * *